US010597942B2

(12) United States Patent
Caresta

(10) Patent No.: US 10,597,942 B2
(45) Date of Patent: Mar. 24, 2020

(54) STEERING SYSTEMS AND METHODS

(71) Applicant: SCHLUMBERGER TECHNOLOGY CORPORATION, Sugar Land, TX (US)

(72) Inventor: Mauro Caresta, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/945,158

(22) Filed: Apr. 4, 2018

(65) Prior Publication Data

US 2018/0283103 A1 Oct. 4, 2018

(30) Foreign Application Priority Data

Apr. 4, 2017 (GB) ..... 1705424.8

(51) Int. Cl.

| | |
|---|---|
| ***E21B 7/06*** | (2006.01) |
| ***E21B 47/00*** | (2012.01) |
| ***E21B 47/12*** | (2012.01) |
| ***E21B 10/42*** | (2006.01) |

(52) U.S. Cl.

CPC ..... *E21B 7/062* (2013.01); *E21B 10/42* (2013.01); *E21B 47/00* (2013.01); *E21B 47/122* (2013.01)

(58) Field of Classification Search

CPC ..... E21B 47/00; E21B 7/062; E21B 10/42; E21B 47/122

See application file for complete search history.

(56) References Cited

U.S. PATENT DOCUMENTS

| | | | | |
|---|---|---|---|---|
| 4,948,925 | A * | 8/1990 | Winters | E21B 7/062 166/113 |
| 5,941,323 | A * | 8/1999 | Warren | E21B 7/062 175/74 |
| 8,534,380 | B2 | 9/2013 | Sheppard et al. | |
| 8,727,036 | B2 | 5/2014 | Johnson et al. | |
| 8,899,352 | B2 | 12/2014 | Johnson et al. | |
| 9,714,543 | B2 | 7/2017 | Downie et al. | |
| 2002/0179336 | A1 * | 12/2002 | Schaaf | E21B 7/06 175/61 |
| 2008/0115974 | A1 | 5/2008 | Johnson et al. | |

(Continued)

FOREIGN PATENT DOCUMENTS

| | | | | |
|---|---|---|---|---|
| WO | 2015127345 | A2 | 8/2015 | |
| WO | 2016187373 | A1 | 11/2016 | |
| WO | WO-2016187373 | A1 * | 11/2016 | E21B 7/062 |

OTHER PUBLICATIONS

Combined Search and Exam Report under Sections 17 and 18(3) of UK Patent Application No. 1705424.8, dated Jul. 27, 2017, 5 pages.

(Continued)

*Primary Examiner* — James G Sayre

(57) ABSTRACT

A steering assembly configured for circumferential disposition about a drill string above a drill head and having top and bottom surfaces, an under-gauge peripheral section, and an over-gauge peripheral section substantially opposing the under-gauge peripheral section, where the maximum under-gauge on the top surface in the under-gauge peripheral section is greater than the maximum over-gauge on the bottom surface in the over-gauge peripheral section.

20 Claims, 6 Drawing Sheets

(56) References Cited

U.S. PATENT DOCUMENTS

| | | | | |
|---|---|---|---|---|
| 2010/0116551 | A1 | 5/2010 | Southard | |
| 2010/0139983 | A1 | 6/2010 | Hallworth et al. | |
| 2011/0139513 | A1 | 6/2011 | Downton | |
| 2012/0080235 | A1* | 4/2012 | Sheppard | E21B 7/06 175/61 |
| 2013/0213713 | A1 | 8/2013 | Smith et al. | |
| 2016/0060959 | A1* | 3/2016 | Lehr | E21B 7/062 175/61 |
| 2017/0058617 | A1* | 3/2017 | Bartel | E21B 7/062 |

OTHER PUBLICATIONS

Search Report and Written Opinion of International Patent Application No. PCT/US2018/025986, dated Jul. 27, 2018, 16 pages.

* cited by examiner

STEERING SYSTEMS AND METHODS

CROSS-REFERENCE TO RELATED APPLICATION

The present application claims priority to and the benefit of United Kingdom Patent Application No. GB 1705424.8, filed on Apr. 4, 2017, the entire disclosure of which is incorporated by reference herein.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

The present disclosure relates generally to a steering assembly for directionally drilling a borehole in an earth formation, and more particularly to a steering assembly comprising an under-gauge section and an over-gauge section and configured for disposal above a drill bit.

Directional drilling is the intentional deviation of a borehole from the path it would naturally take, which may include the steering of a drill string so that it travels in a predetermined direction.

In many industries, it may be desirable to directionally drill a borehole through an earth formation in order to for example circumvent an obstacle and/or to reach a predetermined location in a rock formation.

In the oil and gas industry, controlled directional drilling began in the mid-20th century as a technique to reach otherwise inaccessible hydrocarbon reserves. Early directional drilling involved the use of deflection or side-tracking devices such as whipstocks and simple rotary assemblies to reach the desired target. However, this approach was time-consuming, involving multiple trips of tools and pipe into and out of the borehole, and offered limited control, frequently resulting in missing the target.

Introduction of positive displacement motors offered steering capability and, with it, some degree of directional control. However, these motors lacked the efficiency drillers sought, mainly because of the slide drilling involved.

Slide drilling refers to drilling with a mud motor rotating the bit downhole without rotating the drill string from the surface. The bottom hole assembly at the lower end of a drill string is fitted above the bit with a bent sub or a bent housing mud motor, or both, for directional drilling. With such systems, the bent sub and the bit are pointed in the desired direction. Without turning the drill string, the bit is rotated with a mud motor, and slides in the direction it points. When the desired wellbore direction is attained, the entire drill string is rotated and drills straight rather than at an angle. By controlling the amount of hole drilled in the sliding versus the rotating mode, the wellbore trajectory can be controlled.

Positive displacement motors can produce extreme torque and drag that can limit drilling capability in sliding and rotating modes. Steerable motors can produce unacceptable wellbore tortuosity when drilling in the rotating mode, making further sliding more difficult and impeding critical operations for formation evaluation and running casing. Rotary steerable systems (RSS), which drill directionally with continuous rotation from the surface while pushing the bit or pointing the bit towards the target direction, were introduced to address these issues. RSS eliminate the need to slide the drill string; through continuous rotation transfer weight to the bit more efficiently, thereby increasing rate of penetration; improve hole cleaning by agitating drilling fluid and cuttings, thereby allowing cuttings to flow out of the hole rather than accumulating in cuttings beds; improve directional control in three dimensions; and with a smoother and cleaner wellbore, make formation evaluation and running casing less complicated with reduced risk of getting stuck. However, RSS perform via surface rotation, making them rig-dependent, offer limited selection of bit sizes and speeds, and involve increased mechanical and electronic complexities that can lead to increased costs.

Known forms of RSS include a "counter rotating" mechanism which rotates in the opposite direction of the drill string rotation. Typically, the counter rotation occurs at the same speed as the drill string rotation so that the counter rotating section maintains the same angular position relative to the inside of the borehole. Because the counter rotating section does not rotate with respect to the borehole, it is often called "geostationary" by those skilled in the art. For example, U.S. Pat. No. 8,727,036 is directed toward a geostationary steering cylinder comprising a first under-gauge or full-gauge peripheral section and a second peripheral section opposing the first section, where the distances from the two sections to the center of the bit differ by between 0.5 mm and 20 mm. In particular, FIG. 8K of U.S. Pat. No. 8,727,036 discloses a steering cylinder with a profile which is circular and offset from the drill bit. However, in practice this configuration is difficult to manufacture with precision due to the very small displacement needed and has an under-gauge section that is likely to block the steering cylinder from drilling forward.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to steering systems and methods for drilling a borehole. The steering assemblies of the present disclosure can be disposed above a rotatable drill head, which may be or include a drill bit, and are configured to remain substantially geostationary while the drill head rotates. A steering assembly of the present disclosure may include an under-gauge peripheral section and an over-gauge peripheral section that substantially opposes the under-gauge peripheral section, where the maximum under-gauge on a top surface in the under-gauge peripheral section is greater than the maximum over-gauge on a bottom surface in the over-gauge peripheral section.

The "under-gauge" at a particular point along the circumferential profile of a substantially cylindrical steering assembly is the difference between the nominal full-gauge radius defined by the maximum drill bit cutter tip extension in the radial direction and the lesser radius of the steering assembly at that particular point. Similarly, the "over-gauge" at a particular point along the circumferential profile of a substantially cylindrical steering assembly is the difference between the greater radius of the steering assembly at that particular point and the nominal full-gauge radius defined by the maximum drill bit cutter tip extension in the radial direction.

Thus, in the under-gauge peripheral section the radius of the steering assembly at a particular point is smaller than the full-gauge radius of the drill bit, whereas in the over-gauge peripheral section the radius of the steering assembly at a particular point is larger than the full-gauge radius of the drill bit. In some embodiments, everywhere in the under-gauge section is under-gauge so that the under-gauge section does not block steering. By contrast, the over-gauge section may contain some under-gauge areas.

The maximum radial extension of the drill bit's cutter tips, and therefore the full-gauge radius, is substantially constant. By contrast, the radius of the steering assembly may be substantially constant within the under-gauge peripheral section and/or within the over-gauge peripheral section, in which case the under-gauge and/or the over-gauge radii will remain substantially constant. Alternatively, the radius may vary within the under-gauge peripheral section and/or within the over-gauge peripheral section, in which case the under-gauge and/or the over-gauge will vary accordingly. If the radius of the steering assembly varies within the under-gauge peripheral section and/or within the over-gauge peripheral section, it may vary along the longitudinal axis of the drill head and/or on any plane perpendicular to the longitudinal axis.

The "maximum under-gauge" on a particular plane is the largest under-gauge on that plane. For example, the "maximum under-gauge" on the top surface of the steering assembly is the largest under-gauge on the top surface. "Maximum under-gauge" may also refer, for example, to the largest under-gauge on the bottom surface of the steering assembly and/or on any given plane perpendicular to a longitudinal axis of the drill head and/or the drill string. Similarly, the "maximum over-gauge" is the largest over-gauge on a particular plane e.g. the top surface or the bottom surface, and/or any given plane perpendicular to a longitudinal axis of the drill head and/or the drill string.

The "average maximum over-gauge" is the average of all maximum over-gauge values along the longitudinal axis from the top surface to the bottom surface of the steering assembly. Similarly, the "average maximum under-gauge" is the average of all maximum under-gauge values along the longitudinal axis from the top surface to the bottom surface of the steering assembly.

The over-gauge peripheral section is substantially opposing the under-gauge peripheral section. In embodiments, the maximum over-gauge in the over-gauge peripheral section is substantially opposing the maximum under-gauge in the under-gauge peripheral section.

There are many possible configurations where the maximum under-gauge on the top surface in the under-gauge peripheral section is larger than the maximum over-gauge on the bottom surface in the over-gauge peripheral section. For example, the steering assembly may be in the shape of an oblique cylinder. Alternatively, instead of a circular cross-sectional profile the steering assembly may comprise sections with varying radius. The sections with varying radius may be continuous or may be provided by gauge pads of different thickness around the steering assembly. For example, thinner gauge pads can be provided along the under-gauge section and thicker gauge pads can be provided along the over-gauge section. The gauge pads may be manufactured in one piece or individually, and may be bolt-on pads, for example.

The present disclosure provides a steering assembly wherein the maximum under-gauge on a top surface in an under-gauge peripheral section is greater than the maximum over-gauge on a bottom surface in an over-gauge peripheral section. While the interaction between the borehole wall and the maximum over-gauge on the bottom surface in the over-gauge peripheral section provides a steering force for the drill head to turn in the opposite direction, having a maximum under-gauge on the top surface in the under-gauge peripheral section which is larger creates sufficient space for the drill string to turn without obstruction at the under-gauge side.

The steering assembly of the present disclosure may be fixedly coupled to a drill string such as to a motor and/or a motor collar. This means the steering assembly and the motor or motor collar may be manufactured in one piece to reduce complexity and cost and/or to eliminate adjustable parts and activation mechanisms for improved reliability and operations.

Alternatively, the steering assembly of the present disclosure may be made adjustable so that it can be activated and/or controlled in operation. For example, the steering assembly may be adjustably coupled to a drill string such as to a motor and/or a motor collar so that it may be activated to and/or maintained at an operational position. Adjustment of the steering assembly may be achieved, for non-limiting example, by rotating the steering assembly in relation to the drill string, e.g. around a shared axis or about a pair of hinges where the steering assembly is attached to the drill string.

In embodiments, the maximum under-gauge on the bottom surface in the under-gauge peripheral section is not smaller than (i.e. is greater than or equal to) the maximum over-gauge on the bottom surface in the over-gauge peripheral section. This creates sufficient space for the drill string to turn without obstruction at the bottom surface of the under-gauge side.

In embodiments, the maximum under-gauge on the top surface is not smaller than (i.e. is greater than or equal to) the maximum under-gauge on the bottom surface. More space may be needed at the top because the steering assembly is turning towards the under-gauge side.

In embodiments, the maximum under-gauge in the under-gauge peripheral section at any point between the top surface and the bottom surface is not smaller than (i.e. is greater than or equal to) the maximum over-gauge on the bottom surface in the over-gauge peripheral section. This creates sufficient space for the drill string to turn without obstruction from top to bottom along the longitudinal axis in the under-gauge peripheral section.

In embodiments, the maximum over-gauge on the top surface in the over-gauge peripheral section is greater than the maximum over-gauge on the bottom surface in the over-gauge peripheral section. The larger maximum over-gauge on the top surface may provide further support and stability for steering toward the opposite direction.

In embodiments, the steering assembly of the present disclosure may be configured to be connected to a drill head so that the axial distance between the drill head and the steering assembly is no more than 400 times the average maximum over-gauge in the over-gauge peripheral section. In embodiments, the steering assembly of the present disclosure may be configured to be connected to a drill head so that the axial distance between the drill head and the steering assembly is, for non-limiting example, no more than 400, 100, 40, 10, or any other multiplier less than 400, times the average maximum over-gauge in the over-gauge peripheral section.

In embodiments, the steering assembly of the present disclosure provides a small distance between the steering assembly and the drill head. This allows for a small average maximum over-gauge, which in turn leads to better hole quality as the assembly is configured to produce neat holes only slightly bigger than the full gauge of the drill bit.

In embodiments, the steering assembly of the present disclosure may be configured to be connected to the drill head so that the distance between the drill head and the steering assembly may be less than 200 mm. In embodiments, the steering assembly of the present disclosure may be configured to be connected to the drill head so that the distance between the drill head and the steering assembly is, for non-limiting example, less than 200 mm, 100 mm, 50 mm, or any other distance less than 200 mm, including negligible distance or no distance.

A shorter distance between the steering assembly and the drill head also improves the steering effectiveness of the over-gauge section. To achieve the same degree of steering, a smaller maximum over-gauge in the over-gauge peripheral section is needed when the distance between the steering assembly and the drill head is shorter. Conversely, a longer distance between the steering assembly and the drill head would require a larger over-gauge in the over-gauge peripheral section.

As a result, the average maximum over-gauge in the over-gauge peripheral section can be relatively small, and similarly the average maximum under-gauge in the under-gauge peripheral section can also be relatively small. In embodiments, the average over-gauge of the over-gauge section may be, for non-limiting example, less than 10 mm, less than 5 mm, and/or less than 2 mm. In embodiments, the average under-gauge of the under-gauge section may be, for non-limiting example, less than 20 mm, less than 10 mm, and/or less than 4 mm.

In some embodiments, the steering assembly comprises a plurality of gauge pads for steering and a plurality of junk slots to allow drill mud to pass through. The gauge pads may be fixedly or adjustably coupled to the steering assembly.

The steering assembly of the present disclosure may be part of a mud motor, a turbine, an electric motor, or any other suitable component along a drill string. The steering assembly of the present disclosure may be manufactured, formed, or assembled separately from, or as an integral part of (in a single piece) with, any one or more of such other drill string component(s).

The present disclosure also provides methods for drilling a wellbore in an earth formation in a predetermined direction using the presently disclosed steering systems. In embodiments, these methods may include positioning the steering assembly above a drill head with a top surface further from the drill head and a bottom surface closer to the drill head, determining a predetermined direction in which the drill head is intended to drill, determining a measured direction in which the drill head is tending to drill, comparing the measured direction with the predetermined direction, activating the steering assembly (e.g. by rotation) to point the under-gauge peripheral section toward the predetermined direction, and, in embodiments, maintaining the steering assembly geostationary while rotating the drill head during drilling. Additional details regarding operations of the steering system will be provided below with reference to FIGS. 1-6.

Various refinements of the features noted above may be made in relation to various aspects of the present disclosure. Further features may also be incorporated in these various aspects as well. These refinements and additional features may be made individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION

Figure 1:
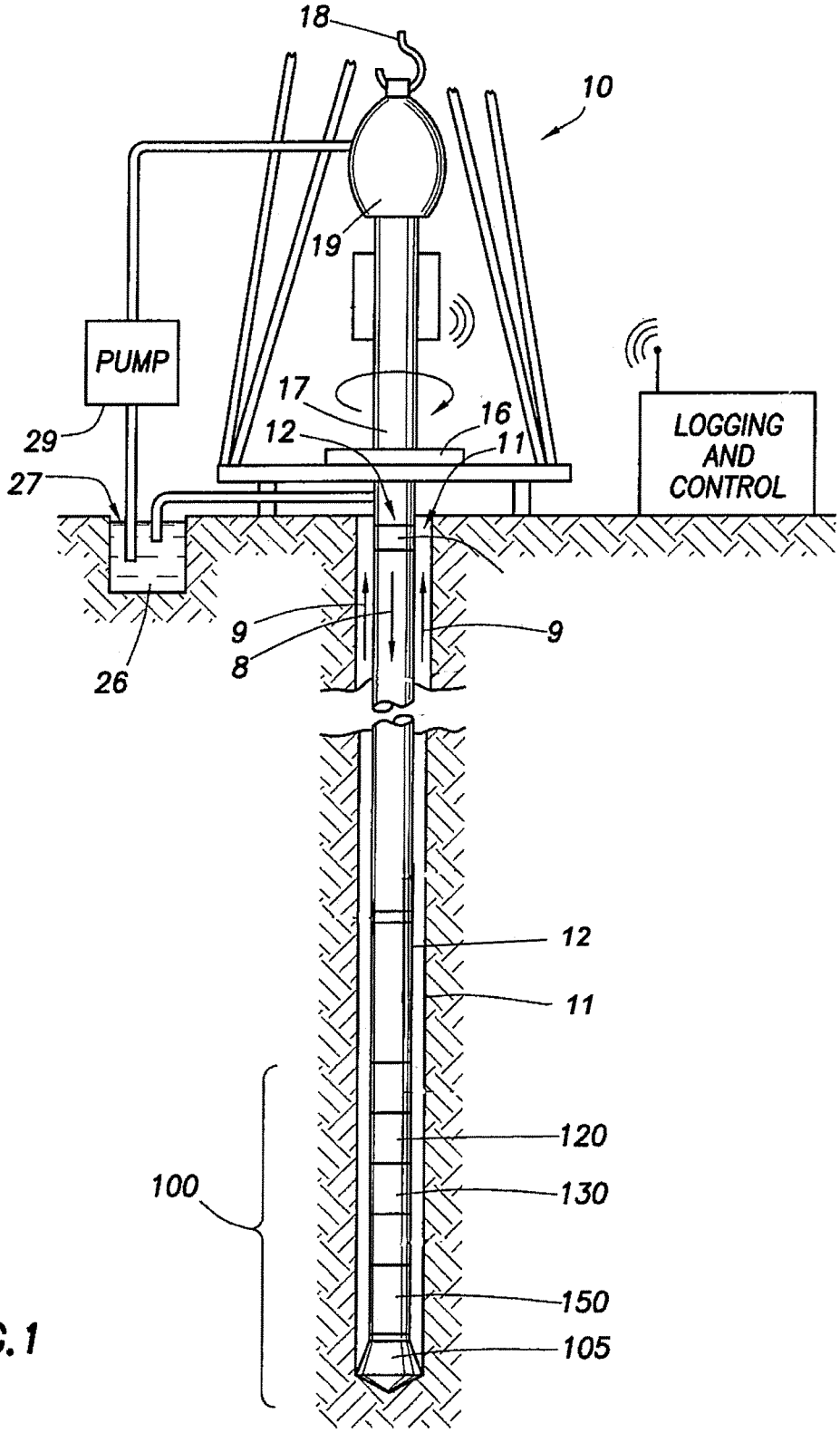
FIG. 1 schematically illustrates an exemplary wellsite system in which the systems and methods of the present disclosure can be employed.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The drawing figures are not necessarily to scale. Certain features of the embodiments may be shown exaggerated in scale or in somewhat schematic form, and some details of conventional elements may not be shown in the interest of clarity and conciseness. Although one or more embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to intimate that the scope of the disclosure, including the claims, is limited to that embodiment.

When introducing elements of various embodiments of the present disclosure, the articles "a," "an," and "the" are intended to mean that there are one or more of the elements. The terms "including" and "having" are used in an open-ended fashion, and thus should be interpreted to mean "including, but not limited to . . . " Any use of any form of the terms "couple," or any other term describing an interaction between elements is intended to mean either an indirect or a direct interaction between the elements described.

Certain terms are used throughout the description and claims to refer to particular features or components. As one skilled in the art will appreciate, different persons may refer to the same feature or component by different names. This document does not intend to distinguish between components or features that differ in name but not function, unless specifically stated.

Embodiments of the present disclosure relate to directional drilling, and in particular to improved steering systems and methods.

By way of introduction, FIG. 1 illustrates an exemplary well in which the systems and methods of the present disclosure can be employed. The well can be located onshore or offshore. In this exemplary system, a borehole 11 is formed in subsurface formations by rotary drilling in a manner that is well known. As illustrated, a drill string 12 is suspended within the borehole 11 and has a bottom hole assembly 100 which includes a drill bit 105 at its lower end. The surface system includes platform and derrick assembly 10 positioned over the borehole 11 being drilled, the assembly 10 including a rotary table 16, kelly 17, hook 18, and rotary swivel 19. The drill string 12 is rotated by the rotary table 16, energized by means not shown, which engages the kelly 17 at the upper end of the drill string 12. The drill string 12 is suspended from the hook 18 which is attached to a traveling block (not shown), through the rotary swivel 19 which permits rotation of the drill string 12 relative to the hook 18, through the kelly 17 and rotary table 16, and into the borehole 11. As is well known, a top drive system could alternatively be used.

The surface system may further include drilling fluid or mud 26 stored in a pit 27 formed at the well site. During drilling operations, a pump 29 delivers the drilling fluid 26 to the interior of the drill string 12 via a port in the swivel 19, causing the drilling fluid 26 to flow downwardly through the drill string 12 as indicated by the directional arrow 8. The drilling fluid 26 exits the drill string 12 via ports in the drill bit 105, then circulates upwardly through the annulus region between the outer wall of the drill string 12 and the inner wall of the borehole 11, as indicated by the directional arrows 9. In this well-known manner, the drilling fluid 26 lubricates the drill bit 105 and carries formation cuttings up to the surface as the drilling fluid is returned to the pit 27 for recirculation.

As illustrated, in addition to the drill bit 105 the bottom hole assembly 100 may include, by way of example, a logging-while-drilling (LWD) module 120 and/or a measurement-while-drilling (MWD) module 130, and a motor 150. The motor 150 may be or include a mud motor, a turbine, or an electric motor. A steering assembly in accordance with the present disclosure may be fixedly or adjustably coupled to the motor 150, for example, to a motor collar.

Figure 2B:
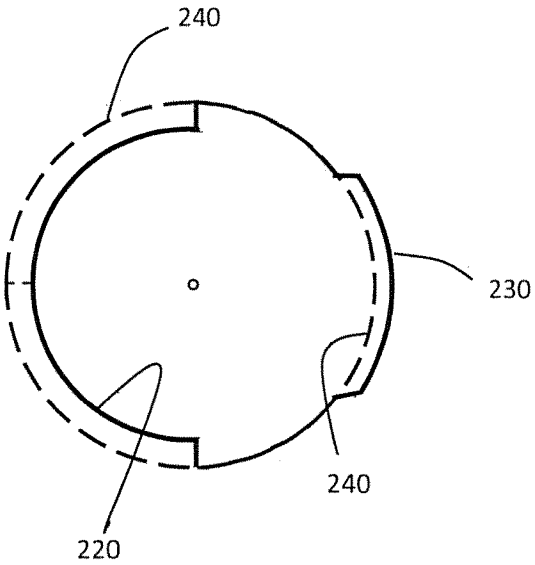
FIGS. 2A and 2B illustrate a steering assembly comprising an under-gauge peripheral section and an over-gauge peripheral section according to an embodiment of the present disclosure.
Figure 2A:
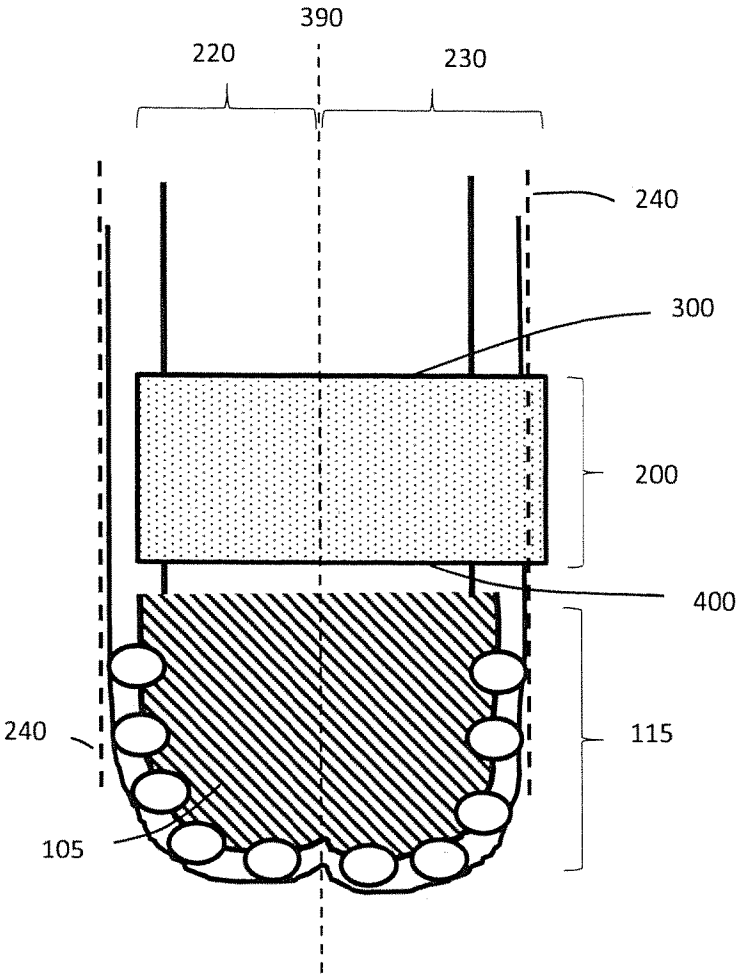

Referring to FIG. 2A, a steering assembly 200 in accordance with embodiments of the present disclosure is shown. The steering assembly 200 is configured for disposal circumferentially about a drill string 12 above a drill head 115, which may be or include a drill bit 105. The drill head 115 is configured to rotate and to drill a borehole 11 in an earth formation as described above, and the steering assembly 200, when activated for steering, may be configured to remain substantially geostationary while the drill head 115 rotates.

As shown, the steering assembly 200 is substantially in the form of a cylinder or tube and is configured to be placed above the drill head 115 with a bottom surface 400 located near or adjacent to the drill head (with or without direct contact) and a top surface 300 located further away from the drill head (i.e. closer to the surface).

FIG. 2B is a cross-section of the steering assembly 200 of FIG. 2A. The nominal hole gauge or full gauge 240, depicted by dotted boundaries in FIGS. 2A and 2B, represents the "full-gauge" used to define under-gauge (less than full-gauge) and over-gauge (greater than full-gauge) in the discussion below.

FIGS. 2A and 2B depict a steering assembly 200 of the present disclosure including an under-gauge peripheral section 220 and an over-gauge peripheral section 230 substantially opposing the under-gauge peripheral section 220. The maximum under-gauge on the top surface 300 in the under-gauge peripheral section 220 is greater than the maximum over-gauge on the bottom surface 400 in the over-gauge peripheral section 230.

There are many possible arrangements for the steering assembly of the present disclosure. Although the steering assembly 200 in FIG. 2A is illustrated as having a substantially right cylinder shape, it can have a substantially oblique cylinder shape, varying radius along its length, a curvilinear shape, and/or any other suitable shape. By its nature, the steering assembly 200 must be capable of bending with the drill string 12.

In some embodiments, the steering assembly 200 may have sections with varying radius. Varying radius can be achieved in discrete increments by providing gauge pads of different thickness around the steering assembly 200. For example, one or more thinner pads (of varying thickness) can be provided in the under-gauge section 220 and one or more thicker pads (of varying thickness) can be provided in the over-gauge section 230. Alternatively, the steering assembly 200 may have sections of varying radius which are continuous and/or may be manufactured in one piece. Like other gauge pads, gauge pads for sections of varying thickness can be affixed to or supplied with the steering assembly 200 in numerous ways, for example by being bolted on or integrally formed.

In embodiments, using one or more geostationary over-gauge pads in the over-gauge section 230 above drill head 115 and/or drill bit 105 in a preferential direction allows steering systems and methods of the present disclosure to provide efficient preferential lateral depth of cut (DOC) limitation with consequent steering in an opposite direction, where lateral DOC is enhanced by the under-gauge section 220.

Figure 3B:
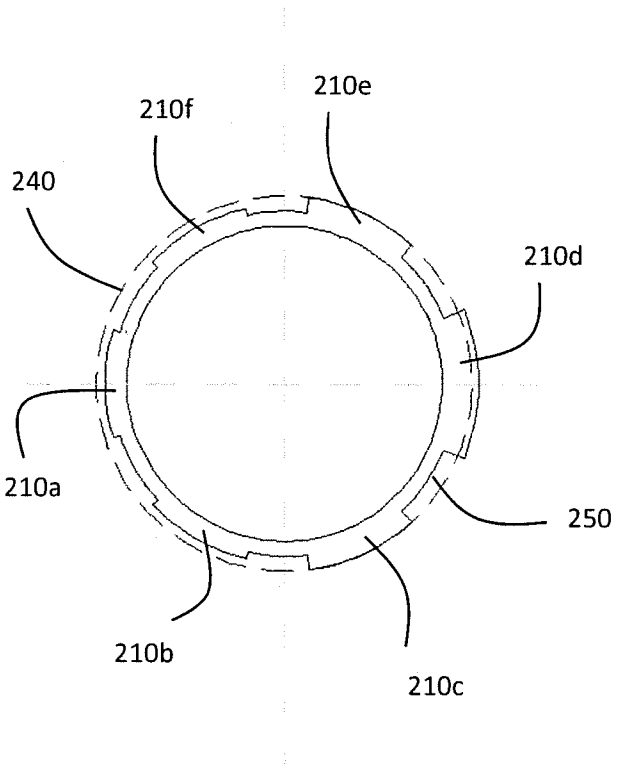
FIGS. 3A and 3B illustrate a steering assembly comprising multiple gauge pads according to an embodiment of the present disclosure.
Figure 3A:
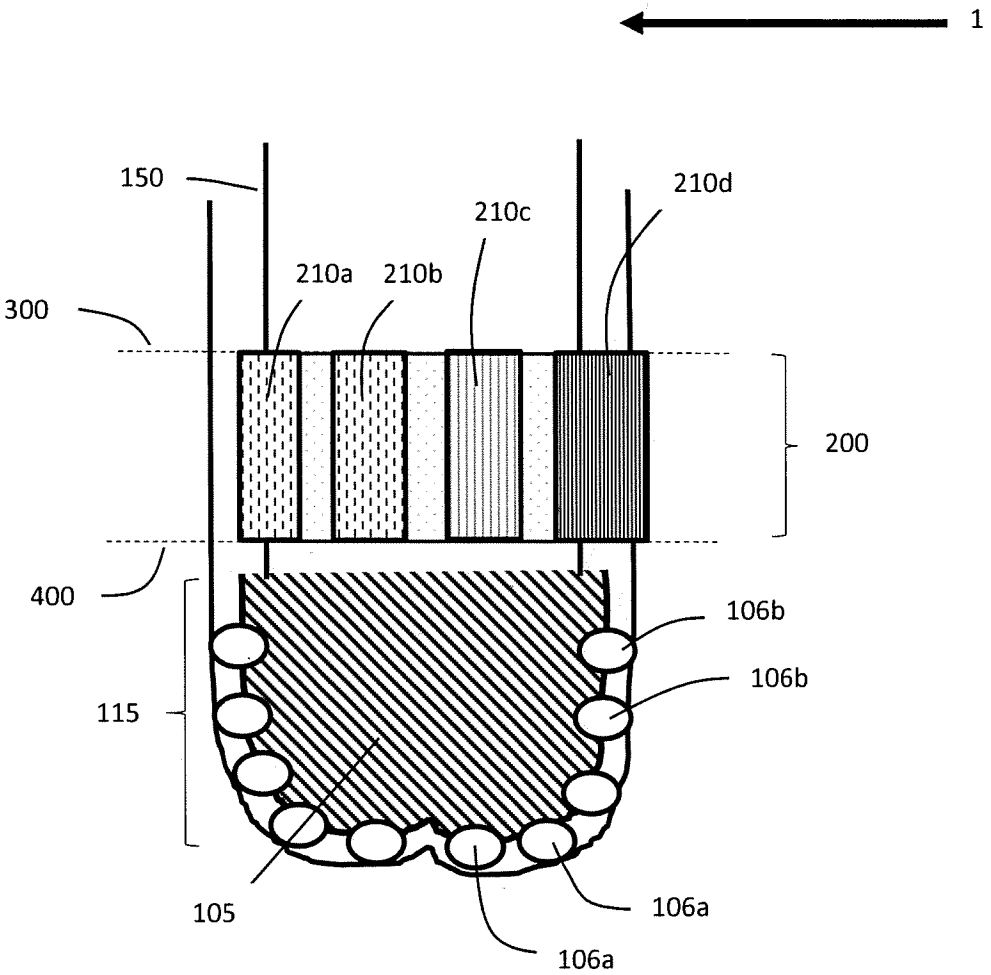

FIG. 3A shows another embodiment of the steering assembly of the present disclosure. As before, the steering assembly 200 is configured for disposal above a drill head 115. As shown, the drill head 115 comprises a drill bit 105 having a plurality of cutters 106*a*, 106*b* and is configured to rotate the bit 105 and drill a borehole in a subterranean formation. The plurality of cutters includes one or more front cutters 106*a* configured for cutting a face of the borehole. The plurality of cutters also includes one or more side cutters 106*b* arranged circumferentially around the drill bit 105 and configured for cutting a sidewall of the borehole, wherein the side cutters 106*b* define the full gauge of the drill head 115.

The steering assembly 200 may be a geostationary element comprising a set of blades 210*a*-210*f* that act as gauge pads. As shown in FIG. 3A and in the cross-section of FIG. 3B, the blade gauge pads can be made for example of six blades 210*a*-210*f* In this example, the three blades 210*a*, 210*b*, and 210*f* on one side of the steering assembly 200 are under-gauge to allow lateral cutting in the preferential steering direction 1. The three under-gauge blades 210*a*, 210*b*, 210*f* allow a higher lateral depth of cut (DOC) and naturally allow the system to steer in the predetermined direction.

On the opposite side, two blades 210*c*, 210*e* are full-gauge to enhance stability in an orthogonal direction to the steering direction 1. Blade 210*d* between the full-gauge blades is slightly over-gauge to efficiently limit lateral cut in the orthogonal direction opposite to the steering direction 1. Over-gauge pad 210*d* also may be made circumferentially shorter to avoid limitation of (enhance) movement in the axial direction. In between the gauge pads 210 are junk slots 250 which are significantly under-gauge to allow drilling mud 26 to pass through in operation.

The gauge pads 210*a*-210*f* preferentially limit the lateral depth of cut (DOC) in an orthogonal direction to the steering direction 1, allowing the drill string 12 to steer toward the predetermined direction 1 where the under-gauge section 230 is pointing. The disposition of the blades 210 *a*-210*f* ensures that the system has a limited lateral DOC below the over-gauge section 230 and more stability in the steering direction, which may be any predetermined direction including without limitation substantially horizontal.

In embodiments, the steering assembly 200 of the present disclosure may be part of or attached to an independent collar, for example a drill collar close to the bit or a motor collar of a downhole motor 150. In both cases, the steering assembly 200 should be geostationary for the purpose of directional biased motion, i.e. the steering assembly rotational axis should have no eccentricity with respect to the drill string rotational axis 390.

Figure 4:
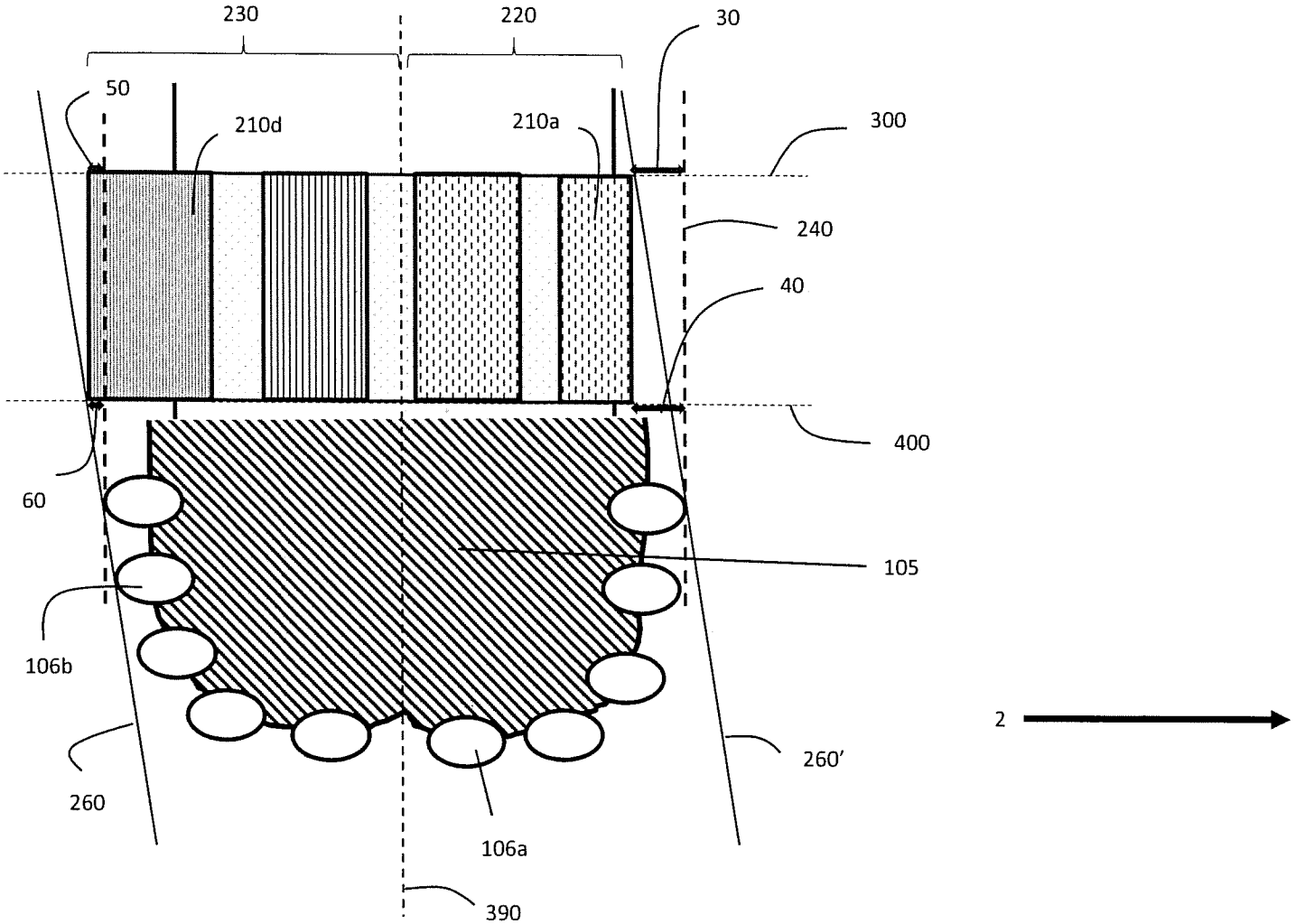
FIG. 4 illustrates a steering assembly according to an embodiment of the present disclosure showing how the size of the under-gauge and the over-gauge affects the assembly's ability to steer.

Referring to FIG. 4, a steering assembly 200 is shown in the form of a cylinder with top surface 300 and bottom surface 400 above the drill head 115, an over-gauge peripheral section 230 to cause steering toward preferential steering direction 2, i.e. away from the over-gauge section 230, and an under-gauge peripheral section 220 to allow space for such steering to occur. As previously described, although the steering assembly 200 is illustrated as substantially cylindrical, it may be of another suitable shape for surrounding a drill string 12 and/or variable in shape, and capable of curvature with the drill string 12 during directional drilling and/or steering operations. When drilling starts, the drill bit 105 will deviate toward the preferential steering direction 2, following the deviation line 260, 260'. The deviation line 260, 260' is defined by the over-gauge 60 (of over-gauge pad 210*d*) on the bottom surface 400 of the steering assembly 200, and by the side cutters 106*b* (on the bit 105) below the over-gauge 60.

As a consequence, progressive opening of the borehole will follow the deviation line 260, 260', as long as the under-gauge pads (e.g. 210*a*) allow sufficient space especially at the top surface 300 to avoid any interference with the borehole wall drilled below by side cutters 106*b*. However, if the under-gauge pads (e.g. 210*a*) extend beyond the corresponding deviation line 260' on the opposite side, it will limit the hole clearance and steering ability, and the steering assembly 200 may even get stuck. Accordingly, in the embodiment shown in FIG. 4, the maximum under-gauge 30 (as defined by under-gauge pad 210*a*) on the top surface 300 in the under-gauge peripheral section 220, between deviation line 260' and full gauge 240, is greater than the maximum over-gauge 60 (as defined by over-gauge pad 210*d*) on the bottom surface 400 in the over-gauge peripheral section 230, between full gauge 240 and deviation line 260.

Further, in the depicted embodiment, the maximum under-gauge 40 (as defined by under-gauge pad 210*a* with respect to full gauge 240) on the bottom surface 400 in the under-gauge peripheral section 220 is the same or greater than the maximum over-gauge 60 (as defined by over-gauge pad 210*d* with respect to full gauge 240) on the bottom surface 400 in the over-gauge peripheral section 230.

Moreover, as illustrated, in this embodiment the under-gauge 30, 40 is constant in the under-gauge section 220 with respect to the full gauge 240, and the over-gauge 50, 60 is constant in the over-gauge section 230 with respect to the full gauge 240. Accordingly, in the under-gauge peripheral section 220 relative to full gauge 240, the under-gauge 30 at the top surface 300, the under-gauge 40 at the bottom surface 400, and any under-gauge in between, is greater than the over-gauge 60 at the bottom surface 400 in the over-gauge peripheral section 230. This ensures that no point between the top surface 300 and the bottom surface 400 in the under-gauge peripheral section 220 sticks out potentially to block advancement of the steering assembly 200 and the drill bit 105.

Although described as having six gauge pads and/or blades (three under-, two full- and one over-gauge) above, in other embodiments, steering assemblies of the present disclosure may include any number of gauge pads and/or blades, in any combination of over-gauge, full-gauge, and/or under-gauge, and in any combination of size or thickness. For example, while a steering assembly of the present disclosure may have six gauge pads comprising three 1 mm under-gauge pads, two full-gauge pads, and one 0.5 mm over-gauge pad, another steering assembly of the present disclosure may include a total of three, four, five, six, seven, eight, nine, ten or more gauge pads and/or blades in different actual and/or relative number combinations of under-, full-, and over-gauge. In addition, as described above, pads and/or blades of like type need not be the same, i.e. may have different thickness within an under-, full-, or over-gauge section, and individual pads and/or blades may have varying radius as well.

Figure 5:
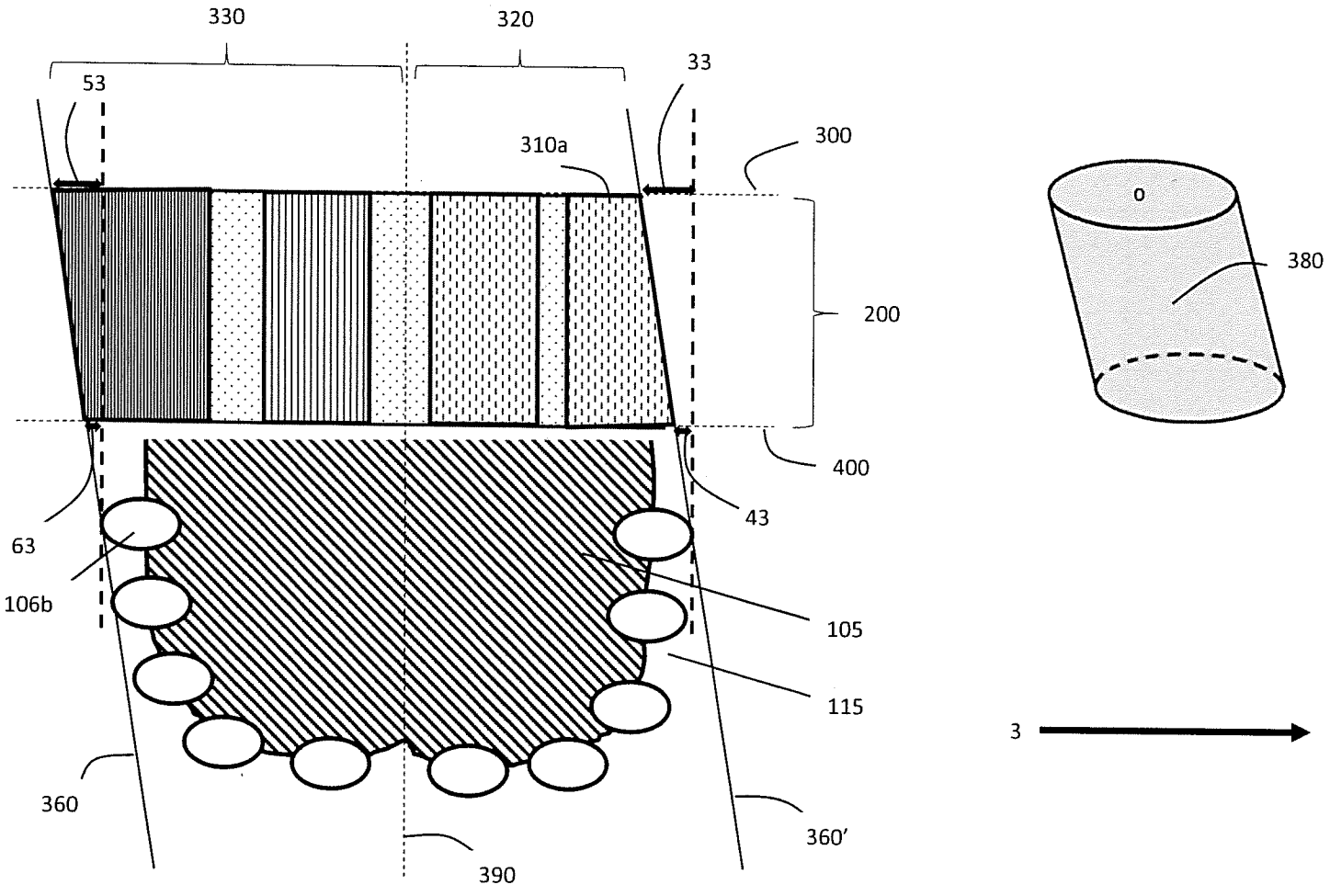
FIG. 5 illustrates a steering assembly in the shape of an oblique cylinder according to an embodiment of the present disclosure.

In some embodiments, a steering assembly 200 may be substantially in the shape of an oblique cylinder 380 which has a gauge variation along the longitudinal axis 390 of the drill head 115, as shown in FIG. 5. The oblique cylinder shape of the steering assembly 200 includes an over-gauge peripheral section 330 to cause steering toward a preferential steering direction 3, i.e. away from the over-gauge section 330, and an under-gauge peripheral section 320 to allow space for such steering to occur. The maximum under-gauge 33 on the top surface 300 in the under-gauge peripheral section 320 is greater than the maximum over-gauge 63 on the bottom surface 400 in the over-gauge peripheral section 330, and the maximum under-gauge 33, 43 at any point between the top surface 300 and the bottom surface 400 in the under-gauge peripheral section 320 is not smaller than (i.e. is greater than or equal to) the maximum over-gauge 63 on the bottom surface 400 in the over-gauge peripheral section 330. For the same reasons as described above, these features allow sufficient space in the under-gauge side for effective steering without interference in the under-gauge direction. As above, regardless of substantial shape, the shape of steering assembly 200 may vary, and at times may be curvilinear with the drill string.

In operation, as soon as drilling starts, the drill bit 105 will deviate in steering direction 3 following the deviation line 360, 360', which is defined by the over-gauge 63 on the bottom surface 400 of the steering assembly 200 and the side cutters 106*b* below the over-gauge 63. As a consequence, progressive opening of the borehole will follow the deviation line 360, 360', as long as the under-gauge pads (e.g. 310*a*) allow sufficient space from the top surface 300 to the bottom surface 400 of the steering assembly 200.

The substantially oblique cylindrical configuration for the steering assembly 200 means that the over-gauge profile (between top surface 300 over-gauge 53 and bottom surface 400 over-gauge 63) can be substantially aligned with the deviation line 360, as shown in FIG. 5. This configuration is more stable in operation because it helps spread the load more uniformly in the over-gauge section 330.

In embodiments, a steering assembly 200 of the present disclosure may be fixedly coupled to a drill string 12, such as by coupling to a collar e.g. the collar of a motor 150, so that the steering assembly 200 moves with the drill string 12. In this case, the steering assembly 200 is kept geostationary in operation by keeping the drill string 12 geostationary. The steering assembly 200 may be adjusted to point to the desirable direction by rotating the drill string 12 from the surface.

In other embodiments, the steering assembly 200 may be rotatably or adjustably coupled to a drill string 12. In this case, the steering assembly 200 is independently adjustable in operation so that the steering assembly 200 may be kept geostationary in operation while the drill string rotates. The steering assembly 200 may be adjusted to point to the desirable direction without rotating the drill string 12. Adjusting the steering direction of the steering assembly 200 may be achieved by rotating the steering assembly with respect to the drill string, e.g. around their shared axis or about a pair of hinges where the steering assembly is attached to the drill string.

Figure 6A:
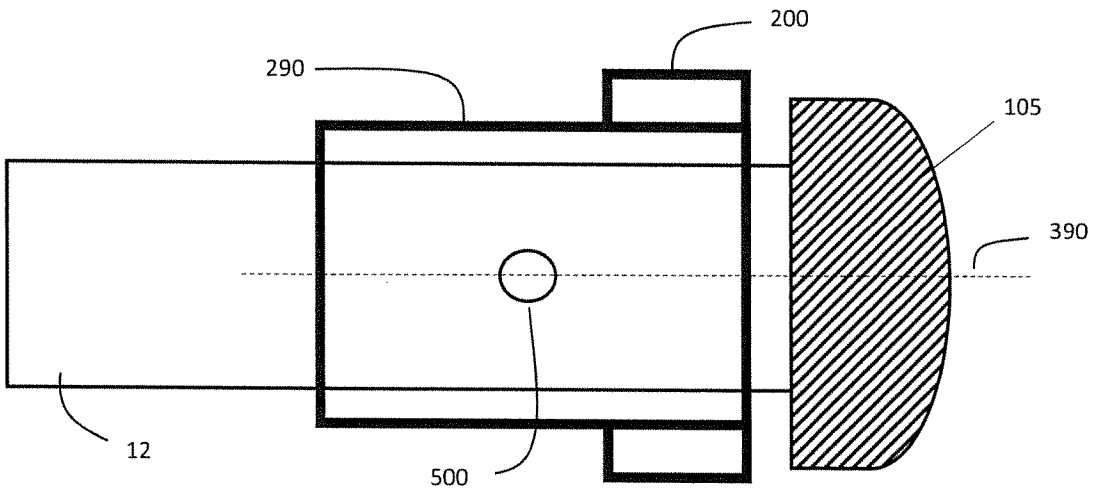
FIGS. 6A and 6B illustrate an activation mechanism for an adjustably coupled steering assembly according to an embodiment of the present disclosure.
Figure 6B:
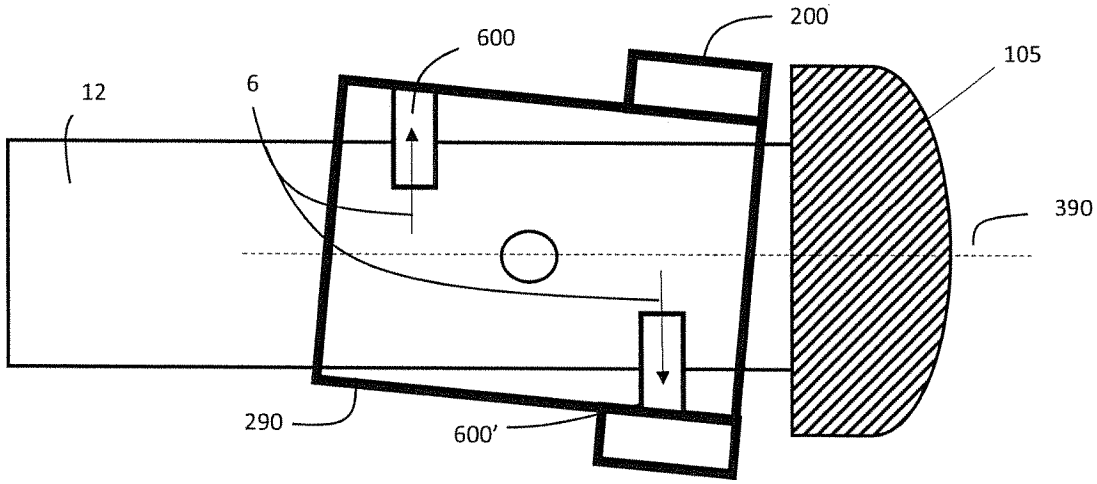

FIGS. 6A and 6B show an example of how a steering assembly 200 in the shape of an oblique cylinder 380 can be rotatably or adjustably coupled to a drill string 12 such as by coupling to a motor 150 and/or a motor collar. In FIG. 6A, a steering assembly 200 is fixedly attached to a carrier body 290 or is integral i.e. they are made in one piece. The carrier body 290 may be adjustably attached to a drill string 12, for example by a pair of hinges 500 on opposite sides of each other. The hinges 500 allow the steering assembly 200 and the carrier body 290 to rotate in relation to the drill string 12 from the position shown in FIG. 6A to the position shown in FIG. 6B. Between the hinges 500, two pistons 600, 600' are provided on opposite sides of each other with respect to the longitudinal axis 390 of the drill string 12, with one piston 600 above the hinges 500 and the other 600' below the hinges 500 with respect to drill bit 105 at the bottom of drill string 12.

In operation, the pair of pistons 600, 600' can be pushed to extend outwardly to activate the steering assembly 200 and convert its configuration to an oblique cylinder shape 380 with respect to the drill string 12. The activation may be powered by hydraulic pressure and/or electric actuators 6. In the straight configuration shown in FIG. 6A, the steering assembly 200 and carrier body 290 are not tilted (i.e. are in axial alignment with the longitudinal axis 390 of the drill string 12) and are held in place by unactivated pistons and/or other means. Once the pistons 600, 600' are activated by hydraulic and/or electric actuators 6, the steering assembly 200 and carrier body 290 are tilted (i.e. are at an angle to the longitudinal axis 390 of the drill string 12), creating an oblique cylinder configuration with respect to the drill bit 105 as shown in FIG. 6B.

The pistons 600, 600' may be set to be activated to extend by different amounts by adjusting the force from actuators 6 applied thereto. The settings for relative piston extension may depend on the desired angle or steering direction, i.e. how much steering is desirable. The hydraulic and/or electric actuators 6 may be maintained so that the steering assembly 200 stays at the set configuration, or increased or decreased to adjust the degree of steering, or stopped to convert the configuration back to the straight position as shown in FIG. 6A.

In embodiments, multiple sets of hinge pairs and/or piston pairs may be provided so that activation of the pistons toward different angles and/or directions are possible without rotating the steering assembly 200 or the drill string 12.

The steering assembly 200 of the present disclosure may be used to steer the drilling of a borehole in an earth formation in a predetermined direction. The steering assembly 200 comprising an under-gauge peripheral section 220 and an over-gauge peripheral section 230 is configured to be positioned above a drill head 115. A direction in which a drill head is tending to drill may be determined, and compared with the predetermined steering direction to evaluate whether an adjustment is necessary. The steering assembly 200 is activated to point the under-gauge peripheral section 220 toward the predetermined direction. Activating the steering assembly 200 to point the under-gauge peripheral section 220 toward the predetermined direction may be achieved by rotating the steering assembly 200 in relation to the drill string 12, e.g. around their shared axis 390 or about a pair of hinges 500 or other means or location where the steering assembly 200 is attached to the drill string 12.

The steering assembly 200 may be kept geostationary maintaining a geostationary steering bias while rotating the drill head 115 to drill further downhole. Following this method, the drill head 115 would drill in the predetermined direction where the under-gauge peripheral section 220 is pointing.

Reference throughout this specification to "one embodiment," "an embodiment," "embodiments," "some embodiments," "certain embodiments," or similar language means that a particular feature, structure, or characteristic described in connection with the embodiment may be included in at least one embodiment of the present disclosure. Thus, these phrases or similar language throughout this specification may, but do not necessarily, all refer to the same embodiment. Although the present disclosure has been described with respect to specific details, it is not intended that such details should be regarded as limitations on the scope of the present disclosure, except to the extent that they are included in the accompanying claims.

While the embodiments set forth in the present disclosure may be susceptible to various modifications and alternative forms, specific embodiments have been shown by way of example in the drawings and have been described in detail herein. However, it should be understood that the disclosure is not intended to be limited to the particular forms disclosed. The disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A steering assembly for directionally drilling a borehole, the steering assembly comprising:

a body configured for disposition circumferentially about a drill string above a drill head, the body having a top surface and a bottom surface, and the drill head defining a gauge of the borehole;

an under-gauge peripheral section; and an over-gauge peripheral section substantially opposing the under-gauge peripheral section;

wherein the under-gauge peripheral section and the over-gauge peripheral section are axially and radially fixed relative to the body, and wherein a maximum under-gauge on the top surface in the under-gauge peripheral section is greater than a maximum over-gauge on the bottom surface in the over-gauge peripheral section.

2. The steering assembly of claim 1, wherein the steering assembly is configured to remain substantially geostationary with the drill string while the drill head rotates.

3. The steering assembly of claim 1, wherein the body is substantially cylindrical.

4. The steering assembly of claim 1, wherein at least one of the under-gauge peripheral section or the over-gauge peripheral section has a constant outer diameter that extends radially outward relative to the drill string.

5. The steering assembly of claim 1, wherein at least one of the under-gauge peripheral section or the over-gauge peripheral section has a variable outer diameter that extends radially outward relative to the drill string.

6. The steering assembly of claim 1, wherein a maximum under-gauge on the bottom surface in the under-gauge peripheral section is greater than the maximum over-gauge on the bottom surface in the over-gauge peripheral section.

7. The steering assembly of claim 1, wherein the maximum under-gauge on the top surface in the under-gauge peripheral section is greater than a maximum under-gauge on the bottom surface in the under-gauge peripheral section.

8. The steering assembly of claim 1, wherein a maximum under-gauge at any point between the top surface and the bottom surface in the under-gauge peripheral section is greater than the maximum over-gauge on the bottom surface in the over-gauge peripheral section.

9. The steering assembly of claim 1, wherein a maximum over-gauge on the top surface in the over-gauge peripheral section is greater than the maximum over-gauge on the bottom surface in the over-gauge peripheral section.

10. The steering assembly of claim 1, wherein the steering assembly is configured to be connected to the drill head so that an axial distance between the drill head and the steering assembly is no more than about 400 times an average maximum over-gauge from the top surface to the bottom surface in the over-gauge peripheral section.

11. The steering assembly of claim 1, wherein the steering assembly is configured to be connected to the drill head so that a distance between the drill head and the steering assembly is less than about 200 mm.

12. The steering assembly of claim 1, wherein an average over-gauge of the over-gauge peripheral section is less than about 10 mm.

13. The steering assembly of claim 1, wherein a maximum over-gauge on the top surface in the over-gauge peripheral section is greater than the maximum under-gauge on the bottom surface in the under-gauge peripheral section.

14. The steering assembly of claim 1, wherein the steering assembly comprises the under-gauge peripheral section and the over-gauge peripheral section, with the under-gauge peripheral section and the over-gauge peripheral section defining a plurality of gauge pads and a plurality of junk slots on the steering assembly, such that one or more gauge pads of the under-gauge peripheral section are under-gauge relative to the drill head and one or more gauge pads of the over-gauge peripheral section are over-gauge relative to the drill head.

15. The steering assembly of claim 1, wherein the body is configured to be coupled to a collar on the drill string.

16. A method for slide drilling a borehole in an earth formation in a predetermined direction, comprising:

positioning a steering assembly circumferentially about a drill string and above a drill head, the drill head defining a gauge of the borehole, and the steering assembly comprising a body having a top surface, a bottom surface, an under-gauge peripheral section at a fixed position relative to the body, and an over-gauge peripheral section at a fixed position relative to the body and substantially opposing the under-gauge peripheral section, wherein a maximum under-gauge on the top surface in the under-gauge peripheral section is greater than a maximum over-gauge on the bottom surface in the over-gauge peripheral section;

determining a direction in which the drill head is tending to drill;

comparing the determined direction with the predetermined direction;

activating the steering assembly to point the under-gauge peripheral section toward the predetermined direction; and maintaining the steering assembly geostationary while rotating the drill head during slide drilling.

17. The method of claim 16, wherein a maximum under-gauge on the bottom surface in the under-gauge peripheral section is greater than the maximum over-gauge on the bottom surface in the over-gauge peripheral section.

18. The method of claim 16, wherein the maximum under-gauge on the top surface in the under-gauge peripheral section is greater than a maximum under-gauge on the bottom surface in the under-gauge peripheral section.

19. The method of claim 16, wherein a maximum under-gauge at any point between the top surface and the bottom surface in the under-gauge peripheral section is greater than the maximum over-gauge on the bottom surface in the over-gauge peripheral section.

20. The method of claim 16, wherein a maximum over-gauge on the top surface in the over-gauge peripheral section is greater than the maximum over-gauge on the bottom surface in the over-gauge peripheral section.

* * * * *